US010290960B2

(12) United States Patent
Tanaka

(10) Patent No.: US 10,290,960 B2
(45) Date of Patent: May 14, 2019

(54) TERMINAL DETACHABLE DEVICE

(71) Applicant: HIROSE ELECTRIC CO., LTD., Tokyo (JP)

(72) Inventor: Hironori Tanaka, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/978,553

(22) Filed: May 14, 2018

(65) Prior Publication Data

US 2018/0337469 A1 Nov. 22, 2018

(30) Foreign Application Priority Data

May 22, 2017 (JP) ..... 2017-100934

(51) Int. Cl.

| | |
|---|---|
| ***H01R 4/48*** | (2006.01) |
| ***H01R 9/20*** | (2006.01) |
| ***H01R 11/12*** | (2006.01) |
| ***H01R 4/36*** | (2006.01) |
| ***H01R 4/00*** | (2006.01) |

(52) U.S. Cl.

CPC ..... *H01R 9/20* (2013.01); *H01R 4/366* (2013.01); *H01R 4/54* (2013.01); *H01R 11/12* (2013.01)

(58) Field of Classification Search

CPC ..... H01R 9/20; H01R 11/12
USPC ..... 439/729, 796, 797, 725, 488, 835, 817, 439/816, 811, 812
See application file for complete search history.

(56) References Cited

U.S. PATENT DOCUMENTS

| | | | | |
|---|---|---|---|---|
| 5,030,139 | A * | 7/1991 | Huska | H01R 4/38 439/513 |
| 7,918,693 | B2 * | 4/2011 | Thomas | F16B 35/005 439/797 |
| 9,548,547 | B2 * | 1/2017 | Wu | H01H 71/08 |
| 2012/0088393 | A1 * | 4/2012 | Siebens | H01R 4/5008 439/370 |
| 2012/0295463 | A1 * | 11/2012 | Okamoto | H01R 13/62944 439/310 |
| 2013/0095683 | A1 * | 4/2013 | Yagome | H01R 13/62944 439/310 |
| 2014/0110230 | A1 * | 4/2014 | Eberts | H01H 71/08 200/237 |
| 2015/0093943 | A1 * | 4/2015 | Nagasaki | H01R 13/193 439/817 |
| 2015/0280333 | A1 * | 10/2015 | Annen | H01R 4/48 417/423.1 |
| 2016/0087365 | A1 * | 3/2016 | Ohkubo | H01R 4/48 439/733.1 |

* cited by examiner

*Primary Examiner* — Abdullah A Riyami
*Assistant Examiner* — Nelson R. Burgos-Guntin
(74) *Attorney, Agent, or Firm* — Rankin, Hill & Clark LLP

(57) ABSTRACT

A terminal detachable device includes a housing; an engaging member that moves in a first direction towards a terminal disposed at a predetermined position of the housing and that engages with the terminal, and that moves in a second direction away from the terminal disposed at the predetermined position and that disengages from the terminal; and an operating member that is rotatably provided with respect to the housing. The engaging member rotates with respect to the housing in accordance with rotation of the operating member, and is movable in the first direction or the second direction with respect to the housing in accordance with rotation of the engaging member with respect to the housing.

8 Claims, 13 Drawing Sheets

TERMINAL DETACHABLE DEVICE

BACKGROUND OF THE INVENTION

1. Field of the Invention

The present invention relates to a terminal detachable device.

2. Description of the Related Art

Terminal detachable devices for attaching and detaching terminals are used in, for example, distribution boards, machine tools, and computer products. Japanese Unexamined Patent Application Publication No. 9-161868 discloses, in particular, an example of a terminal detachable device having a terminal relay function. According to this terminal detachable device, it is possible to attach and detach a terminal by performing a one-touch operation without using screws.

An exemplary structure of the terminal detachable device disclosed in Japanese Unexamined Patent Application No. 9-161868 is shown in FIG. 19. In order to connect a terminal 117 to another terminal 117, a knob section 111 is lifted against an urging force of a coil spring 115, and, in this state, the terminal 117 is inserted into a portion between a connection fitting 108 and a pressing plate 114 at a base 107, and the knob section 111 is released. This causes a rod 112 to be lowered by discharging at the coil spring 115, and, with a protruding portion 122 being inserted into a hole 118, the terminal 117 to be interposed between the pressing plate 114 and the connection fitting 108. In this case, since the rod 112 is inserted in the hole 118, the terminal 117 cannot be removed. In order to remove the terminal 117, it is necessary to, with the knob section 111 being lifted against the urging force of the coil spring 115, remove the rod 112 inserted in the hole 118.

In existing terminal detachable devices, in this way, in order to connect or remove one terminal 117, it is necessary to lift the knob section 111, as a result of which the operation becomes complicated.

SUMMARY OF THE INVENTION

The invention of the present application is made to overcome the above-describe problems of the related art. It is an object of the present invention to make it possible to improve the operability of a terminal detachable device.

To this end, according to an aspect of the present invention, there is provided a terminal detachable device including a housing; an engaging member that moves in a first direction towards a terminal disposed at a predetermined position of the housing and that engages with the terminal, and that moves in a second direction away from the terminal disposed at the predetermined position and that disengages from the terminal; and a rotary member that is rotatably provided with respect to the housing. The engaging member rotates with respect to the housing in accordance with rotation of the rotary member, and is movable in the first direction or the second direction with respect to the housing in accordance with rotation of the engaging member with respect to the housing.

According to this structure, in order to engage the engaging member with the terminal or disengage the engaging member from the terminal, the direction in which the rotary member is operated and the direction in which the engaging member moves from the terminal can differ from each other, and the engaging member is not in itself moved relative to the terminal, so that the engagement of the engaging member and the terminal can be controlled by, for example, rotating the rotary member. Therefore, it is possible to improve the operability of the terminal detachable device.

The terminal detachable device may further include an engagement terminal for disposing the terminal, the engagement terminal having a through hole that allows a part of the engaging member to extend therethrough in the first direction and the second direction.

When the engagement terminal having the through hole is provided, it is possible to, with the terminal in a more stable state, dispose the terminal at a predetermined position of the housing and engage the terminal with the engaging member.

In the terminal detachable device of the aspect, a part of the engaging member may be accommodated in an accommodation space of the rotary member, and, in the accommodation space, the engaging member may be movable in the first direction or the second direction without rotating with respect to the rotary member.

In the terminal detachable device of the aspect of the present invention, the engaging member may be urged at all times in the first direction with respect to the rotary member by elastic means.

According to this structure, it is possible to, without operating the rotary member, automatically engage the engaging member and the terminal by using urging force provided by the elastic means.

In the terminal detachable device of the aspect, the engaging member may be rotatably supported by the rotary member, and the elastic means may be provided in the first direction and the second direction around a shaft of the rotary member that rotatably supports the engaging member.

According to this structure, it is possible to stabilize the operation of the engaging member with respect to the rotary member. In the terminal detachable device of the present invention, it is possible to stably dispose the elastic means.

In the terminal detachable device of the aspect, one of the rotary member and the engaging member may include the shaft extending towards the other of the rotary member and the engaging member, and the other of the rotary member and the engaging member may include a hole that accommodates the shaft and the elastic means.

In the terminal detachable device of the aspect, the first direction and the second direction may be along the shaft.

Further, in the terminal detachable device of the aspect, the engaging member may be movable with respect to the housing in the first direction or the second direction due to contact of the engaging member with a part of the housing.

In the terminal detachable device of the aspect, one of the housing and the engaging member may include inclining means that is inclined along a peripheral surface of the one of the housing and the engaging member in an acute angle direction with respect to the first direction and the second direction, and the other of the housing and the engaging member may include contacting means that is capable of contacting the inclining means and that is provided in correspondence with the inclining means.

According to this structure, it is possible to rotate the engaging member with respect to the housing via the inclining means and the contacting means.

In the terminal detachable device of the aspect, at least a part of the rotary member may be accommodated in the housing, and the housing may have a window where at least a part of the rotary member accommodated in the housing is exposed.

Further, in the terminal detachable device of the aspect, the terminal may be disposed at the predetermined position of the housing by being inserted into the housing in a direction orthogonal to the first direction and the second direction.

In the terminal detachable device of the aspect, the rotary member may be an operating member.

According to the invention of the present application, a terminal detachable device whose operability is improved is provided.

DESCRIPTION OF THE PREFERRED EMBODIMENTS

With reference to the attached drawings, a terminal detachable device is described below as a preferred embodiment of the present invention. As an example, an example of an application of the present invention to a device having a terminal relay function, that is, a function that allows electrical relay to at least two terminals is given. However, this is merely one application example, and is not intended to limit the present invention to devices having a terminal relay function. The present invention is widely applicable to terminal detachable devices that do not have such a terminal relay function.

Figure 1:
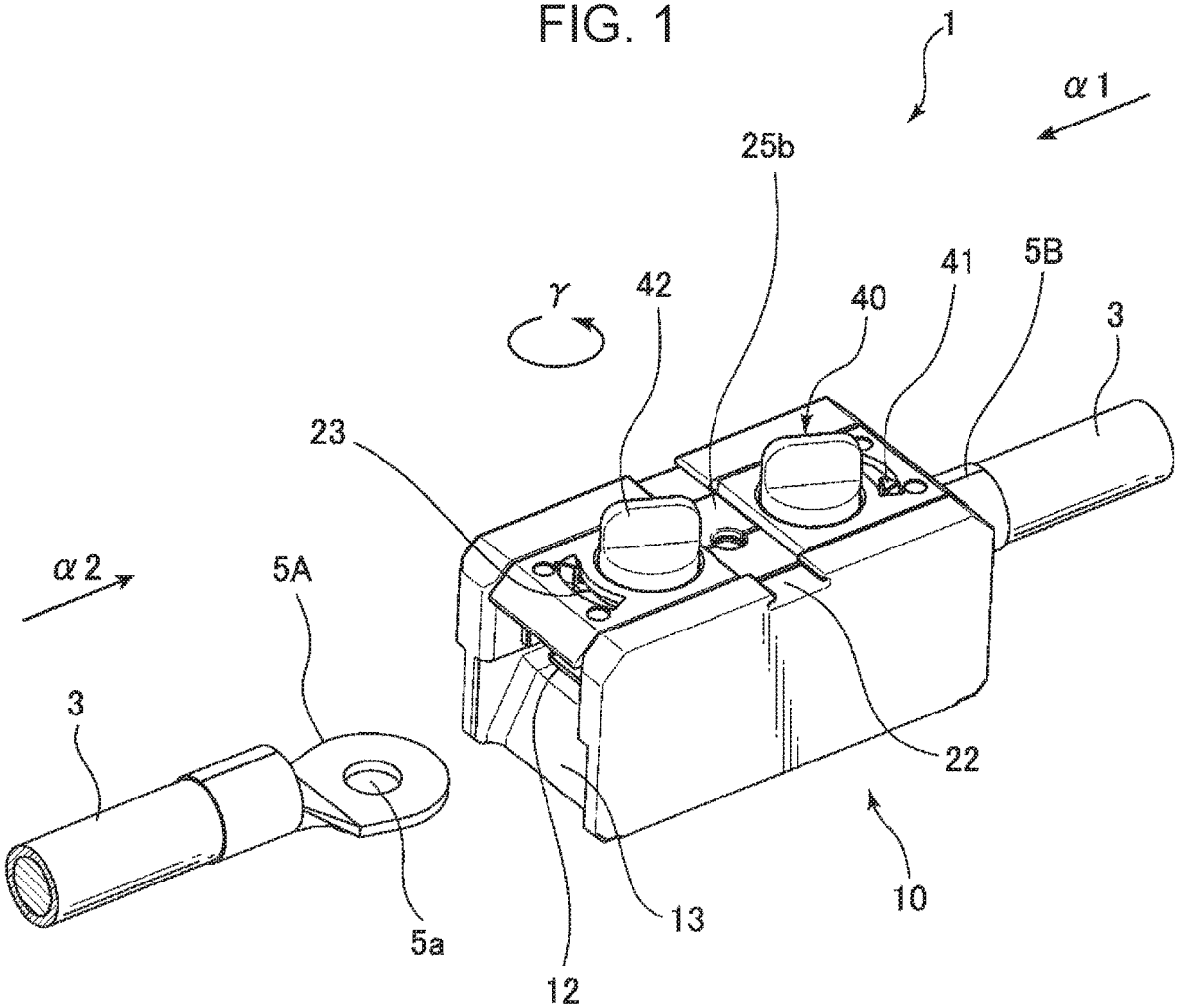
FIG. 1 is a perspective view of an example of a mode of use of a terminal detachable device to which the present invention is applicable.
Figure 2A:
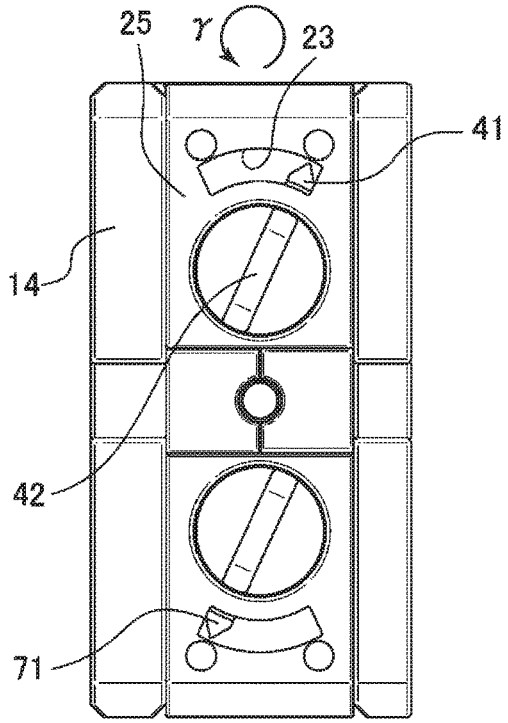
FIGS. 2A to 2C are each a plan view of a mode of use of the terminal detachable device.
Figure 2B:
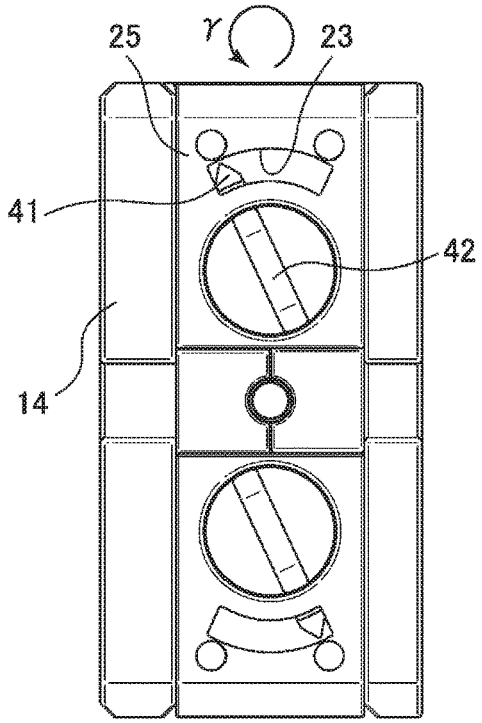
Figure 2C:
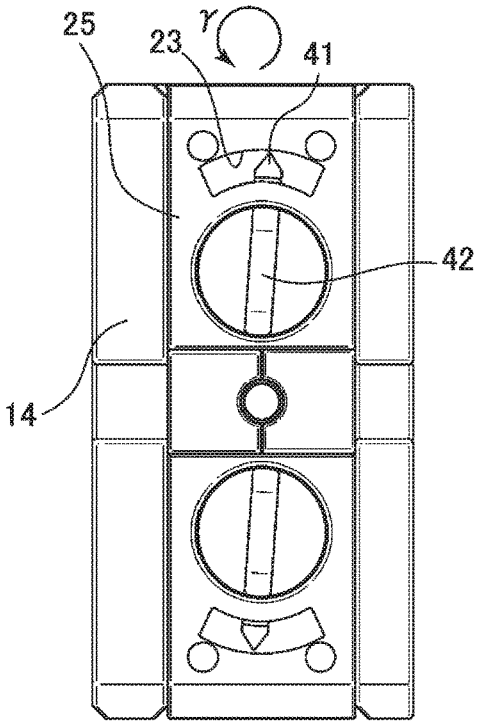

FIG. 1 is a perspective view of an example of a mode of use of a terminal detachable device 1 to which the present invention is applicable. FIGS. 2A to 2C are each a plan view of a mode of use of the device 1. The terminal detachable device 1 is not completely symmetrical, but may be considered to be essentially symmetrical in terms of the application of the present invention.

For example, a pair of terminals 5A and 5B, each mounted on an end of its corresponding cable 3, can be attached to and detached from the terminal detachable device 1. In the example shown in FIG. 1, on one side thereof, the terminal 5A is not yet attached by insertion, and, on the other side thereof, the terminal 5B is already attached by insertion and locked.

By a simple operation, the terminal 5 attached by insertion can be removed, that is, unlocked from the terminal detachable device 1 by using a knob 42 exposed to the outside. The locked state can be switched to an unlocked state by rotating an operating member (rotary member) 40 with respect to a housing 10 in the direction of an illustrated arrow γ. The locked state and the unlocked state can be reliably confirmed visually via windows 23 in the housing 10 of the device 1. As shown in the plan views of FIGS. 2A to 2C, indicating sections 41, each of which is a part of its corresponding operating member 40, are exposed to the outside via the corresponding windows 23. When each indicating section 41 is at its corresponding position shown in FIG. 2A, each indicating section 41 indicates the locked state. When each indicating section 41 is at its corresponding position shown in FIG. 2B, each indicating section 41 indicates the unlocked state. When each indicating section 41 is at its corresponding position shown in FIG. 2C, each indicating section 41 indicates an intermediate state between the locked state and the unlocked state. Since the locked state and the unlocked state can be confirmed via the windows 23, a user can effectively prevent, for example, half-fitting. It is desirable to increase the visibility of each indicating section 41 by coloring each indicating section 41 with a color that differs from that of the surrounding.

Figure 3:
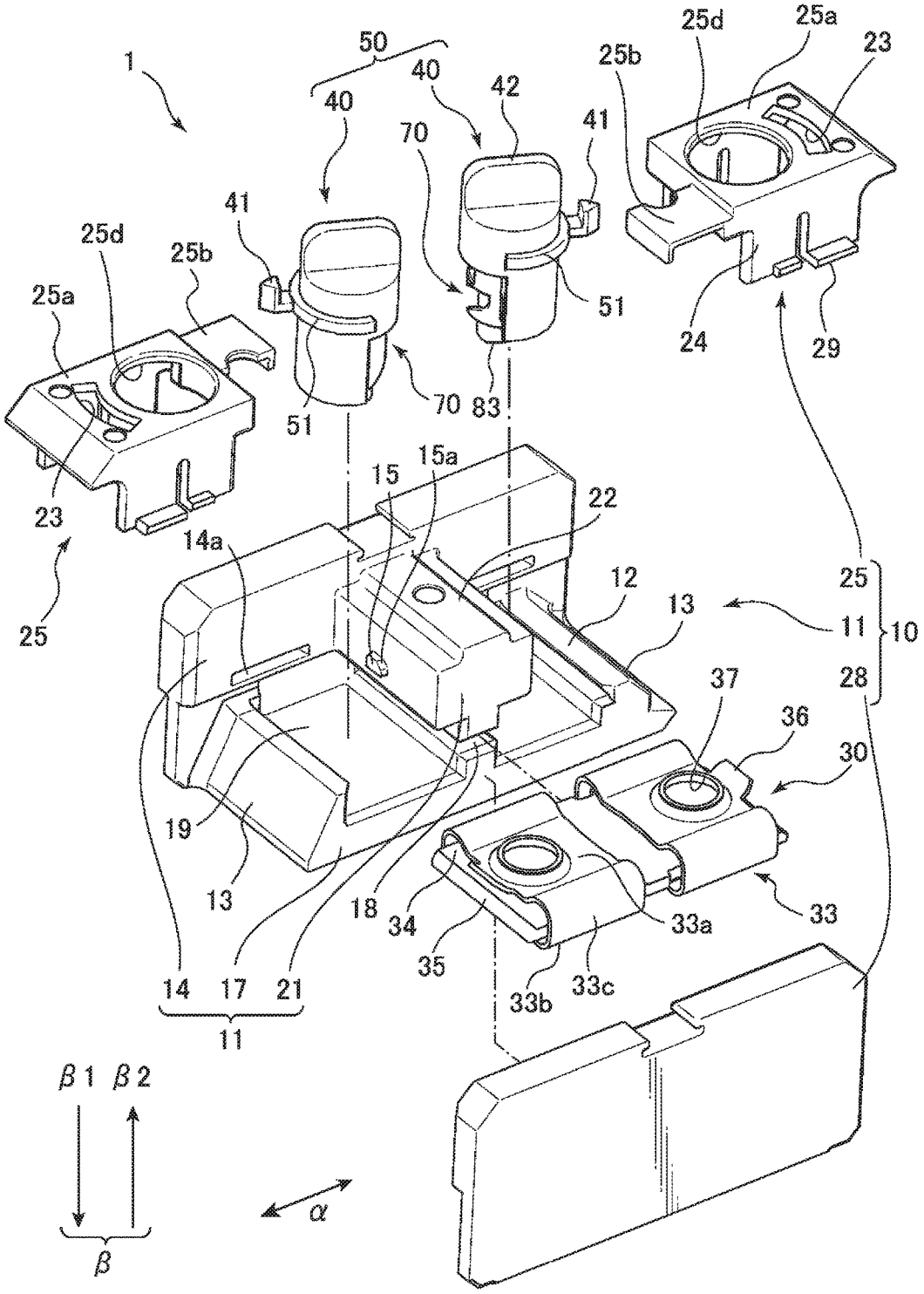
FIG. 3 is a partial exploded perspective view of the terminal detachable device.
Figure 4:
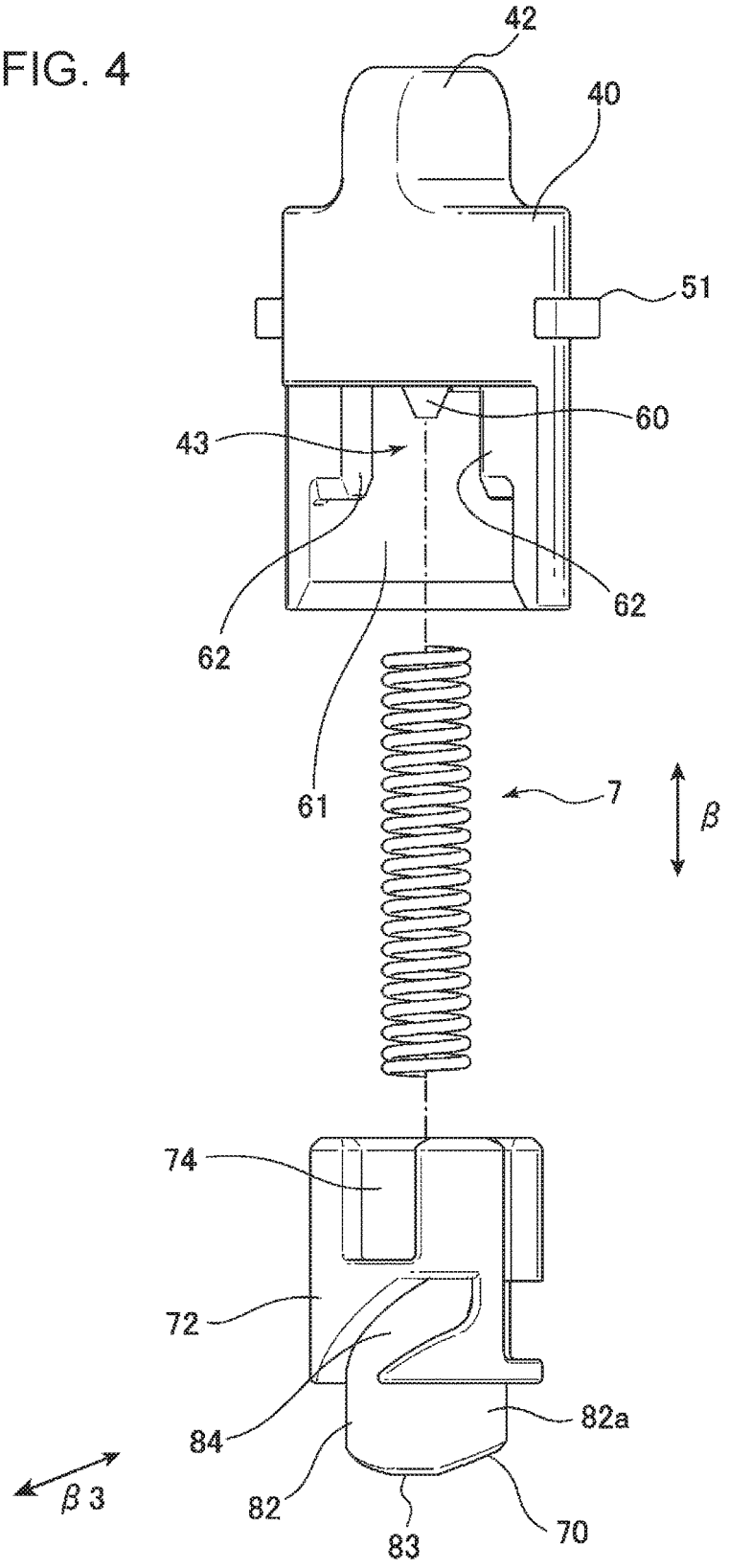
FIG. 4 is an exploded perspective view of an operating unit.
Figure 5:
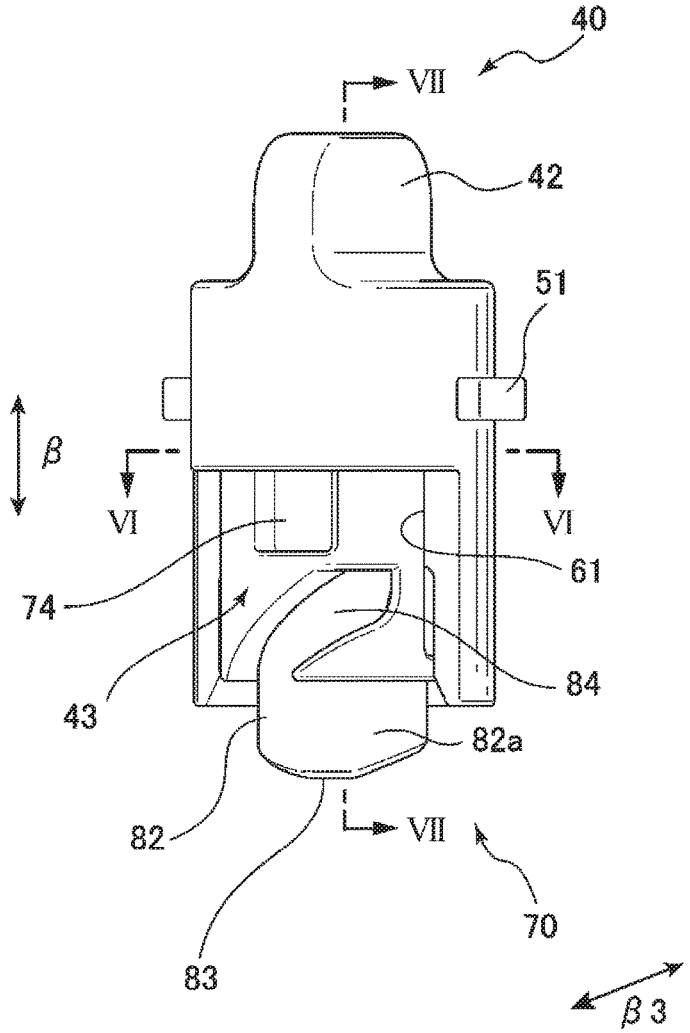
FIG. 5 is a transverse view of the operating unit.
Figure 6:
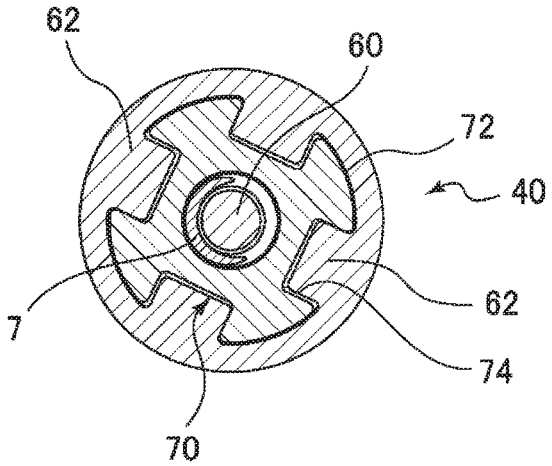
FIG. 6 is a transverse sectional view taken along line VI-VI of FIG. 5.
Figure 7:
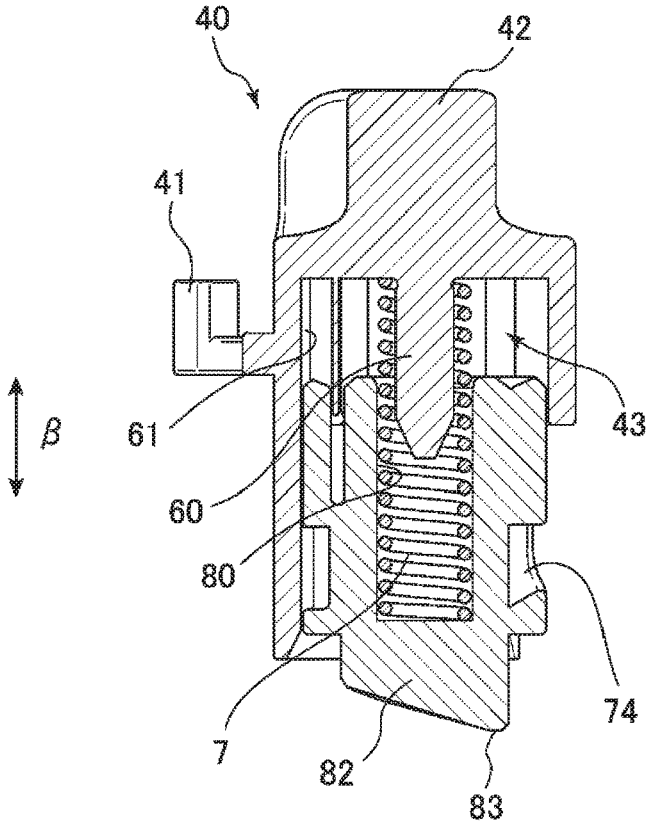
FIG. 7 is a vertical sectional view taken along line VII-VII of FIG. 5.

FIG. 3 is a partial exploded perspective view of the terminal detachable device 1. Further, FIGS. 4 to 7 show in detail an operating unit 50 of the device 1. FIG. 4 is an exploded perspective view of the operating unit 50. FIG. 5 is a transverse view of the operating unit 50. FIG. 6 is a transverse sectional view taken along line VI-VI of FIG. 5. FIG. 7 is a vertical sectional view taken along line VII-VII of FIG. 5.

As is clear from FIG. 3, the terminal detachable device 1 includes the housing 10, a clamping device 30 that is set in the housing 10, and the operating unit 50, a part of which is exposed to the outside of the housing and the other part of which is accommodated in the housing 10. As is clear from FIGS. 4 to 7, the operating unit 50 includes each operating member 40, a part of which is exposed to the outside of the housing 10 and the remaining part of which is accommodated in the housing 10; engaging members 70 that are accommodated in the housing 10 in their entirety; and elastic means, such as coil springs 7, which are accommodated in inner portions of the corresponding operating members 40 and the corresponding engaging members 70 in their entirety.

The clamping device 30 that is set in the housing 10 includes, for example, a busbar 35 and a pair of spring terminals (engagement terminals) 33 (33A, 33B). The busbar 35 is made of an electrically conductive material, such as iron or brass. For example, a metallic plate having a rectangular shape in top view and having a predetermined thickness may be used for the busbar 35. A plate-shaped terminal having a substantially C shape in side view, such as a terminal including an upper portion 33*a* and a lower portion 33*b* connected to each other by a central portion 33*c*, may be used for each spring terminal 33. The spring terminals 33 are disposed one on the left side and the other on the right side of the busbar 35 so as to sandwich the busbar 35 at a location between the upper portions 33*a* and the lower portions 33*b*. In this state, the spring terminals 33 are fixed to the inside of the housing 10.

Openings 12 into which the corresponding terminals 5 are inserted are provided on the corresponding front and back sides of the housing 10 so as to oppose each other. The terminals 5A and 5B are, via the corresponding openings 12, inserted into the housing 10, that is, in directions in which the terminals 5A and 5B approach corresponding gaps 34, formed between the corresponding spring terminals 33 and the busbar 35. The terminals 5A and 5B are, via the corresponding openings 12, removed from the inside of the housing 10, more specifically, in directions away from the corresponding gaps 34. The terminals 5A and 5B may be inserted and removed in a direction $\alpha 1$ or $\alpha 2$, the directions $\alpha 1$ and $\alpha 2$ being orthogonal to movement directions $\beta 1$ and $\beta 2$ of the engaging members 70. When the insertion directions $\alpha$ of the terminals 5 and the movement directions $\beta$ of the engaging members 70 are orthogonal to each other, it is possible to simplify the structure of the device 1. In order to smoothly guide the terminals 5 to the corresponding gaps 34, as in the figures, guiding tapering portions 13 may be formed on a bottom portion 17 of a base member 11 of the housing 10, and guiding-in portions 36 may each be formed on an end of the upper portion 33*a* of its corresponding spring terminal 33.

Through holes 37 that allow part of the corresponding engaging members 70, that is, stopper portions 82 to extend therethrough are each provided near the center of the upper portion 33*a* of its corresponding spring terminal 33. The engaging members 70 are engageable with the corresponding terminals 5 via the corresponding through holes 37. When the terminals 5 are mounted on the device 1, with through holes 5*a* of the terminals being aligned with the through holes 37 of the corresponding spring terminals 33, the through holes 5*a* of the terminals 5 are positioned below the upper portions 33*a* of the corresponding spring terminals 33. As a result, the stopper portions 82 of the corresponding engaging members 70 can be inserted into the through holes 5*a* of the corresponding terminals 5 as well as into the through holes 37 of the corresponding spring terminals 33. When the stopper portions 82 are inserted into the through holes 5*a* of the corresponding terminals 5 via the through holes 37 of the corresponding spring terminals 33, each flat contact portion 83 at an end of its corresponding stopper portion 82 contacts a surface of the busbar 35 disposed below the terminal 5, so that the engaging members 70 and the corresponding terminals 5 engage with each other, that is, the terminals 5 are locked by the corresponding engaging members 70. In this case, even if a person tries to remove the terminals 5 from the housing 10, since the stopper portions 82 get caught by the corresponding holes 5*a* of the terminals 5, the terminals 5 cannot be removed. It is desirable that the contact portions 83 have flat surfaces to increase the contact area with the busbar 35. When the contact portions 83 have planar shapes, it is possible to more stably maintain the engagement state. Although, as described below, the terminals 5 may have recessed portions instead of the through holes 5*a*, when the through holes 5*a* are formed, the terminals 5 are more firmly held by the engaging members 70 than when the terminals 5 merely have recessed portions.

The through holes 37 of the corresponding spring terminals 33 are formed by punching out the spring terminals 33 from one surface to the other surface of each spring terminal 33. Rising portions 37*a* formed by the punching-out operation are formed on the corresponding upper portions 33*a*. The vicinity of end portions of the engaging members 70 are at all times stably held by the corresponding spring terminals 33 by making use of the corresponding rising portions 37*a* in a thickness direction. Therefore, it is possible to stably position the engaging members 70 at predetermined positions of the housing 10.

Here, although, as the terminals 5, round terminals, that is, terminals having the through holes 5*a* at substantially the corresponding centers in plan view are used, the terminals 5 are obviously not intended to be limited to such round terminals. As is clear from the description below, as long as the terminals 5 can engage with the engaging members 70, for example, terminals having recessed portions at the positions of the through holes instead of the through holes 5*a*, or terminals having rectangular shapes in plan view may be used.

The housing 10 includes the base member 11, a side wall 28 that covers one side of the base member 11, and upper covers 25 that form an upper portion of the housing 10.

The base member 11 includes the bottom portion 17, a side portion 14 that is provided vertically with respect to the bottom portion 17, and a body portion 21 that is connected to the bottom portion 17 via the side portion 14.

Depression portions 19 are provided in an upper surface of the bottom portion 17 of the base member 11. The lower portions 33*b* of the corresponding spring terminals 33 mounted on the busbar 35 of the clamping device 30 are disposed in the corresponding depression portions 19. A gap 18 into which the busbar 35 is inserted is provided between the bottom portion 17 and the body portion 21. The clamping device 30 can be mounted on the base member 11 such that the busbar 35 on which the spring terminals 33A and 33B are mounted on the left and right sides, respectively, is inserted into the gap 18 at an exposed portion of the busbar 35 near the center of the busbar 35 between the spring terminals 33A and 33B.

The body portion 21 of the base member 11 has protrusions 15 that can engage with portions of the corresponding engaging members 70 (that is, guide grooves 84 shown in FIG. 4, etc.). In order to make collisions with the guide grooves 84 smooth, engaging surfaces 15*a* that engage with the corresponding guide grooves 84 are tapered.

Each upper cover 25 is fixed to the base member 11 by setting a portion 25*b* of a body portion 25*a* of its corresponding upper cover 25 on a top portion 22 of the body portion 21, and by inserting a mounting portion 29 of each side plate portion 24 that is provided on one side surface of the body portion 25*a* of its corresponding upper cover 25 into a corresponding fixing hole 14*a* of the side portion 14.

The body portion 25*a* of each upper cover 25 includes a through hole 25*d* where a part of its operating member 40 can be removed to the outside. Each operating member 40 is partly held at all times in its corresponding through hole 25*d* such that each operating member 40 is supported at a predetermined position of the housing 10. One of the side surfaces of the body portion 25*a* of each upper cover 25 includes the side plate portion 24 extending perpendicularly to the corresponding body portion 25*a*. Further, an edge of each side plate portion 24 includes the mounting portion 29 protruding sideways. After mounting each upper cover 25 on the base member 11, each mounting portion 29 of its corresponding side plate portion 25 is fitted to its corresponding fixing hole 14*a* of the side portion 14 and a similar corresponding fixing hole (not shown) of the side wall 28 to make it possible to fix the side portion 14 and the side wall 28 to the upper covers 25.

Figure 8:
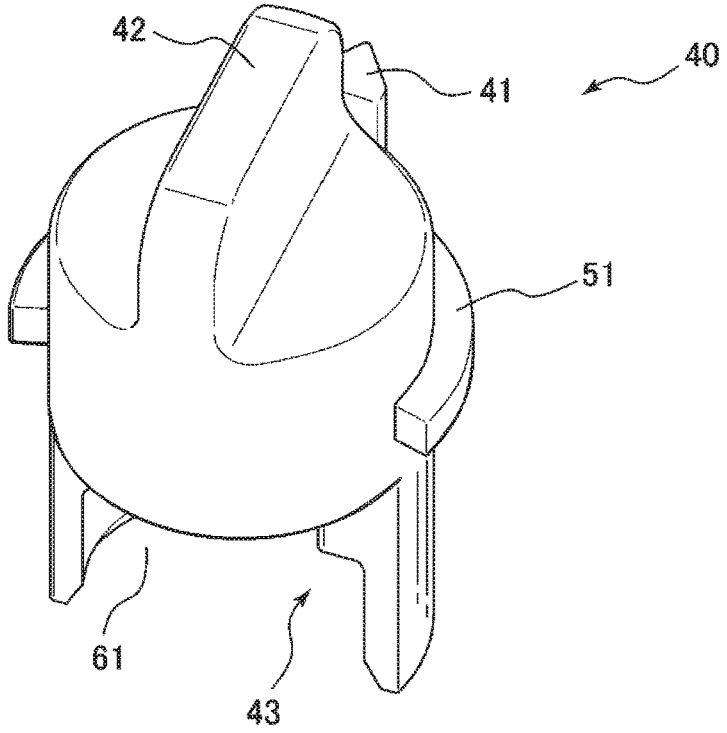
FIG. 8 is a perspective view of an operating member.
Figure 9:
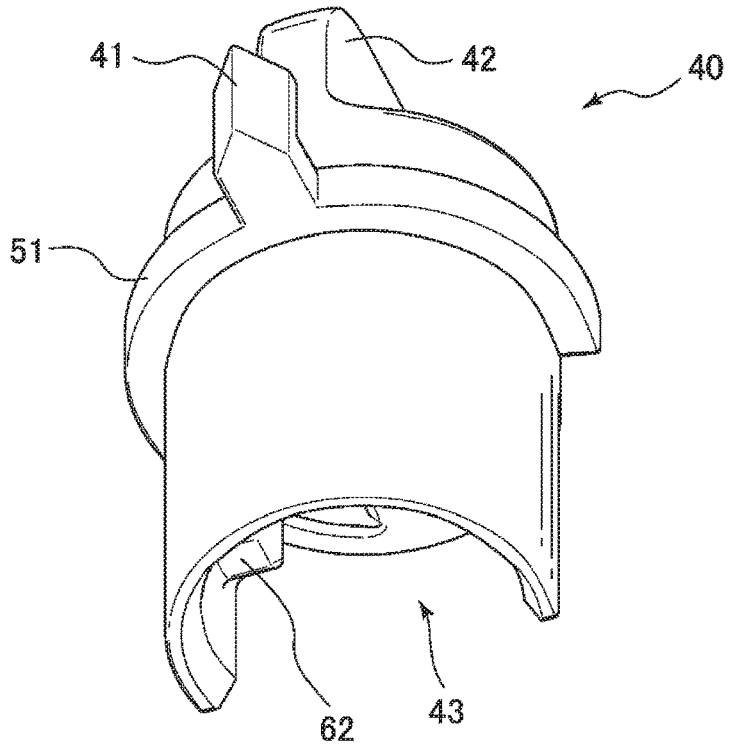
FIG. 9 is a perspective view of the operating member.
Figure 10:
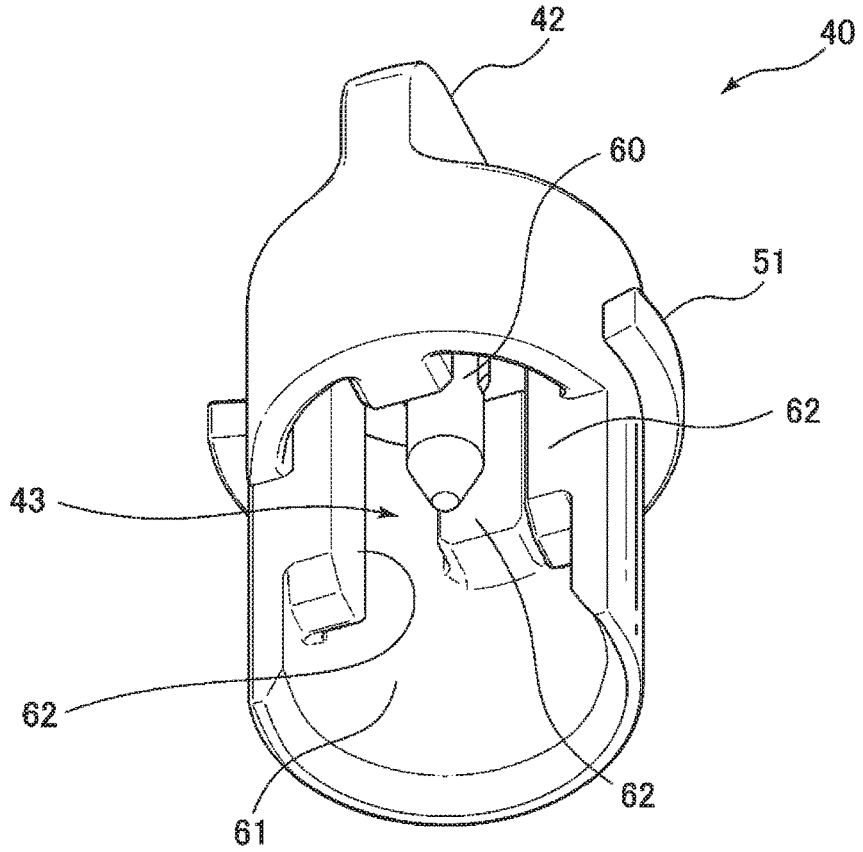
FIG. 10 is a perspective view of the operating member.
Figure 11:
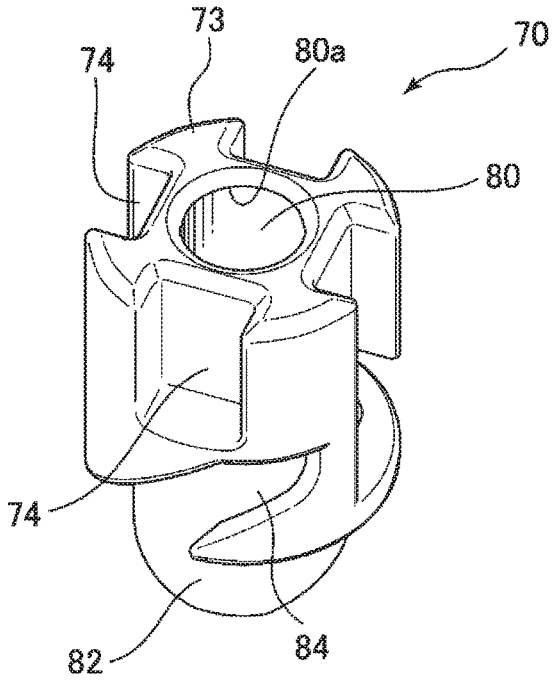
FIG. 11 is a perspective view of an engaging member.
Figure 12:
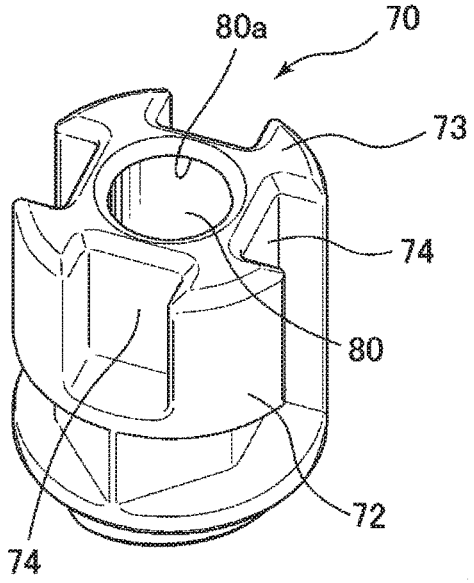
FIG. 12 is a perspective view of the engaging member.
Figure 13:
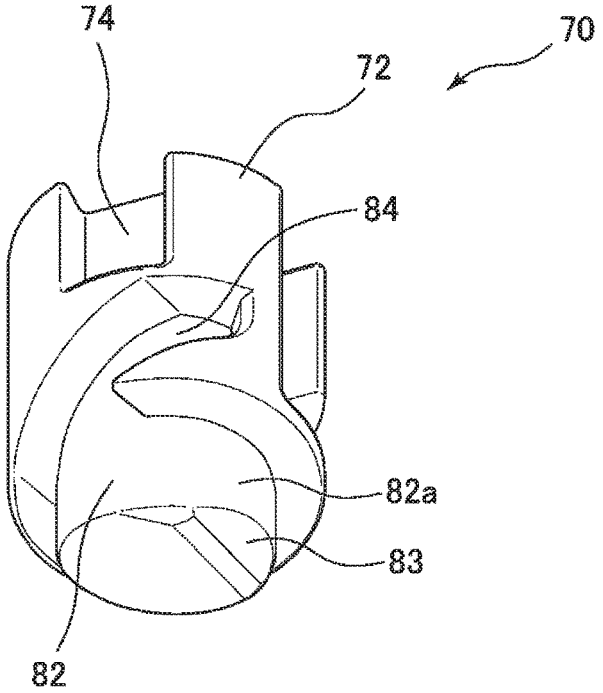
FIG. 13 is a perspective view of the engaging member.
Figure 14:
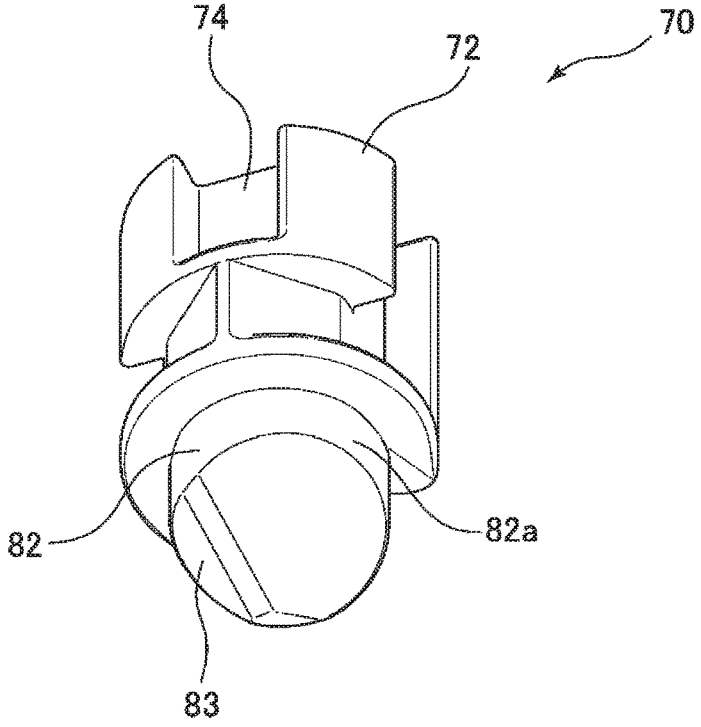
FIG. 14 is a perspective view of the engaging member.

FIGS. 8 to 10 are each a perspective view of one operating member 40. As shown in these figures and FIGS. 3 to 7, each operating member 40 has a closed end and a substantially cylindrical shape excluding the knob 42 that is located on a top portion. An outer peripheral surface of each operating member 40 includes a protruding portion 51 that abuts upon an inner wall of the corresponding cover 25 and positions the corresponding operating member 40 with respect to the housing 10, and the corresponding indicating section 41 that extends from the protruding portion 51. The operating members 40 each have an accommodation space 43 for accommodating the corresponding engaging member 70. A part of each engaging member 70 is rotatably accommodated in the corresponding accommodation space 43 in a state in which each engaging member 70 is movable vertically in directions β. In order to restrict the movement of the each engaging member 70, a shaft 60 extending downward from a ceiling of the corresponding operating member 40 is provided in the corresponding accommodation space 43. An inner wall 61 of each operating member 40 that defines the corresponding accommodation space 43 includes a plurality of (here, four) positioning protrusions 62 extending vertically along the length directions β.

FIGS. 11 to 14 are each a perspective view of one engaging member 70. Each engaging member 70 has a substantially columnar shape as a whole, and includes the corresponding stopper portion 82 having a relatively large large-diameter portion on an upper portion thereof and a relatively small small-diameter portion on a lower portion thereof. An upper portion of each large-diameter portion 72 has a vertical hole 80 in correspondence with the shaft 60 of its corresponding operating member 40. Each shaft 60 and each coil spring 7 that is wound around the corresponding shaft 60 in the directions β are inserted into the corresponding vertical hole 80. Each engaging member 70 is rotatably supported with respect to its corresponding operating member 40 by its corresponding shaft 60 inserted in its corresponding vertical hole 80. Each engaging member 70 is urged downward in the direction β1 with respect to its corresponding operating member 40 at all times by its corresponding coil spring 7 provided around its corresponding shaft 60. In order to facilitate the insertion of each shaft 60 and each coil spring 7, a tapered portion is provided at an insertion opening 80*a* of the corresponding vertical hole 80.

Depressions 74 extending vertically in the length directions β are provided in an outer peripheral surface of an upper side of each large-diameter portion 72 in correspondence with the positioning protrusions 62 that are provided on the inner wall 61 of the corresponding operating member 40. Each engaging member 70 is set in the accommodation space 43 of its corresponding operating member 40 with the depressions 74 of each engaging member 70 and the positioning protrusions 62 of each operating member 40 being disposed in correspondence with each other. As a result, each engaging member 70 is movable vertically along its corresponding shaft 60 in the directions β in the accommodation space 43 of its operating member 40. That is, each engaging member 70 is movable between a lock position and an unlock position in the directions β. Each inclining means whose surface is continuously formed with a peripheral surface 82*a* of the corresponding stopper portion 82, for example, a guide groove 84 that is formed by making use of a difference between the thickness of the large-diameter portion 72 and the thickness of the stopper portion 82 in the radial direction is provided at an outer peripheral surface of a lower side of the corresponding large-diameter portion 72. The protrusions 15 (see FIG. 3) that are provided on a part of the housing 10 are disposed in the corresponding guide grooves 84. When the engaging members 70 are rotated with respect to the housing 10, the engaging members 70 are movable with respect to the operating members 40 and the housing 10 in a direction in which the engaging members 70 approach the clamping device 30 (a first direction, here, the downward direction β1) and in a direction in which the engaging members 70 move away from the clamping device 30 (a second direction, here the upward direction β2) due to the contact between the guide grooves 84 and the corresponding protrusions 15.

Each guide groove 84 is provided in an inclined state along the peripheral surface 82*a* of its corresponding engaging member 70 (see FIGS. 4 and 5) in an acute angle direction β3 with respect to the movement directions β of the engaging members 70. In order to simplify the structure, the directions β1 and β2 are exactly opposite each other in the embodiment, but need not be exactly opposite each other. The directions β1 and β2 may be in other directions.

Figure 15:
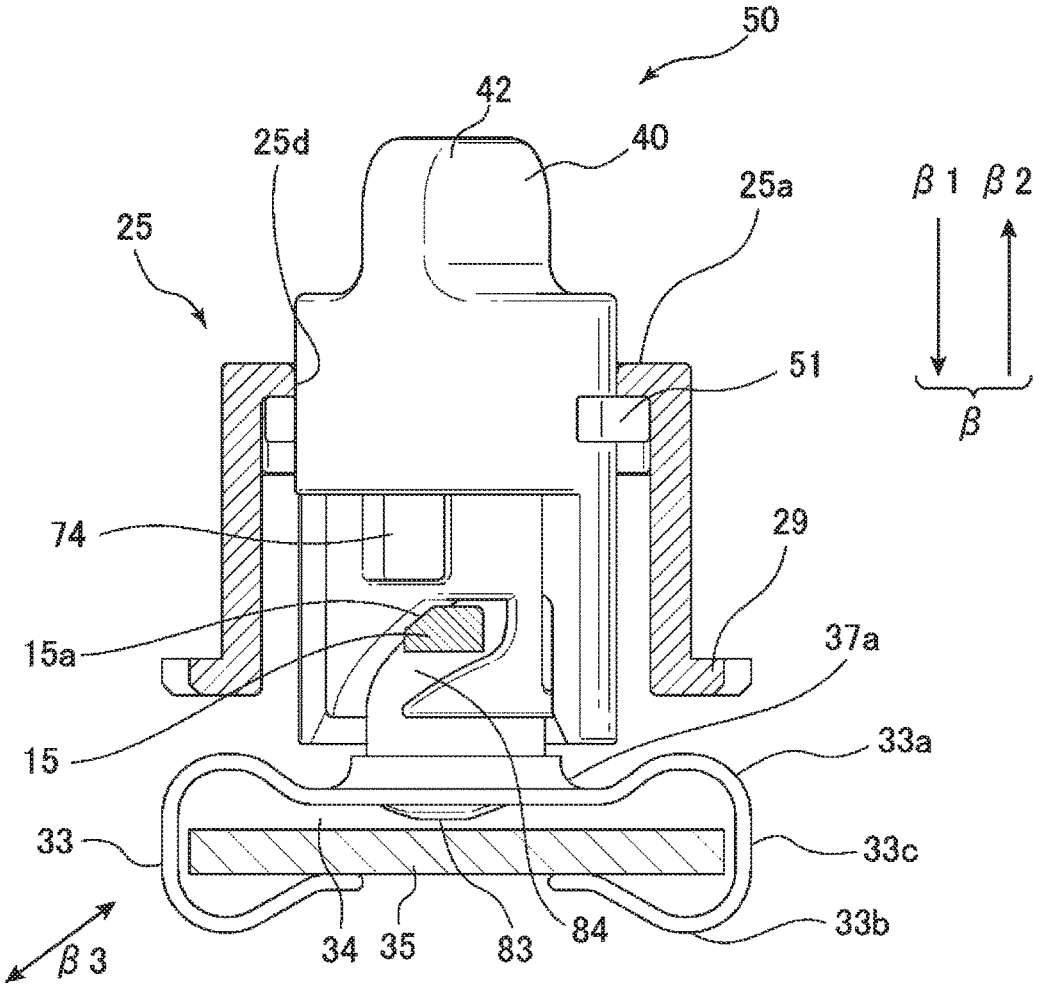
FIG. 15 is a transverse view of a locked state.
Figure 16:
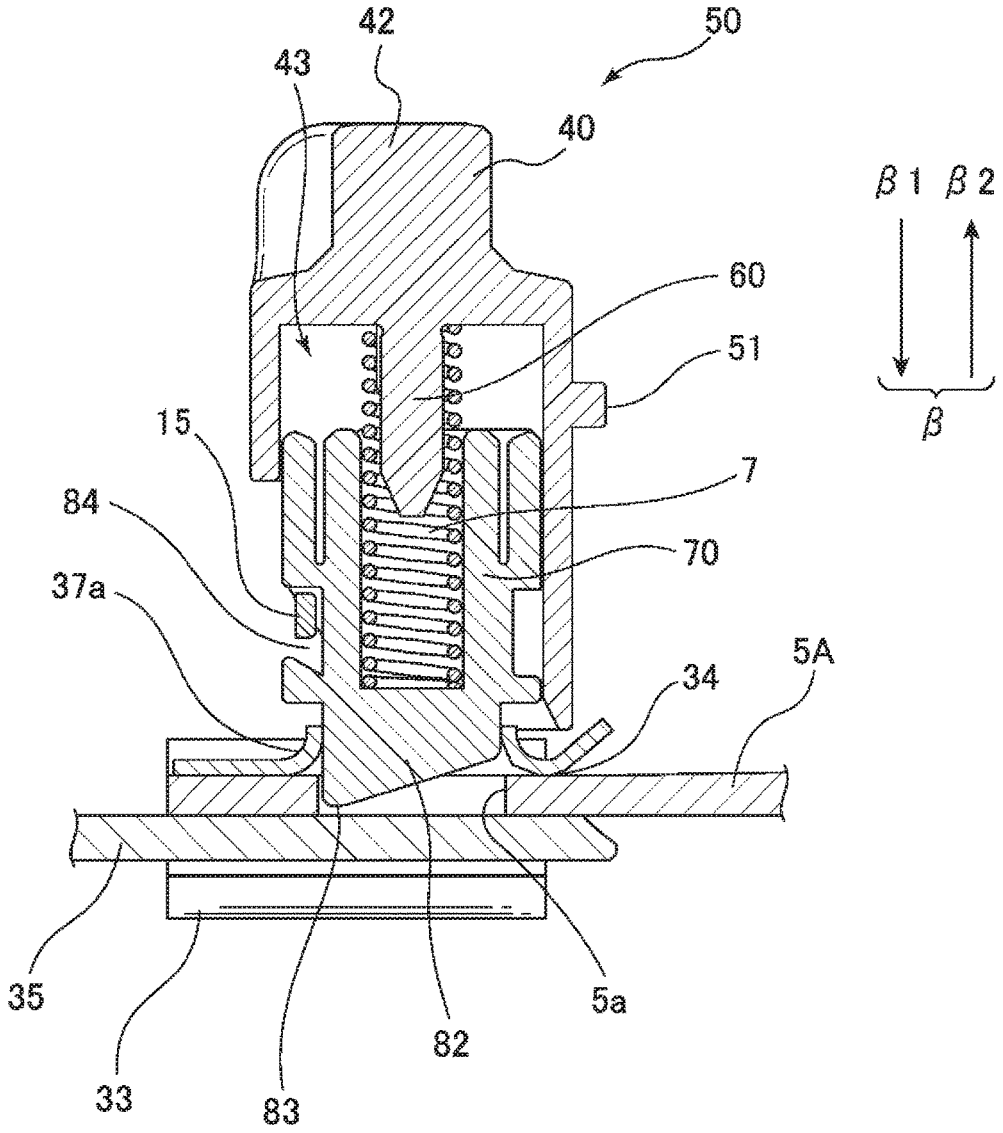
FIG. 16 is a sectional view of the locked state.
Figure 17:
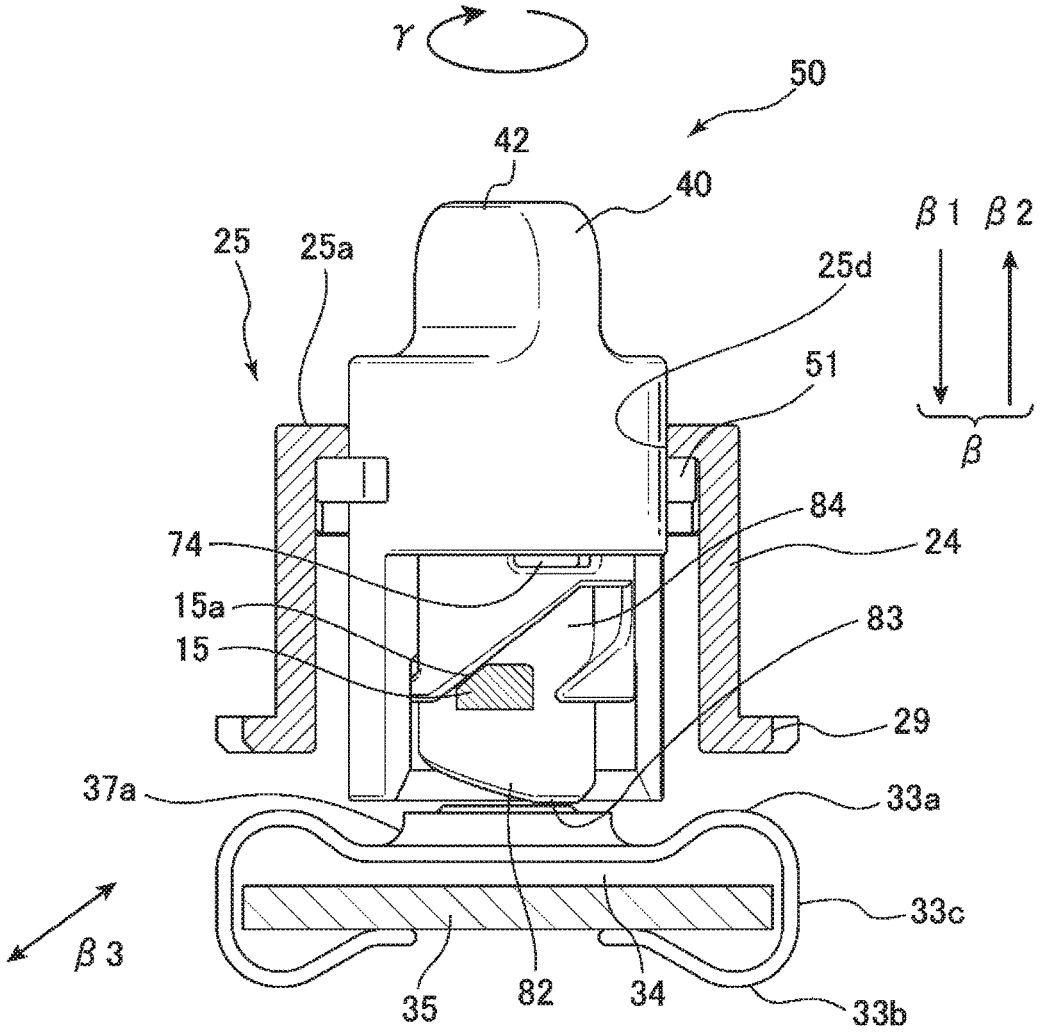
FIG. 17 is a transverse view of an unlocked state.
Figure 18:
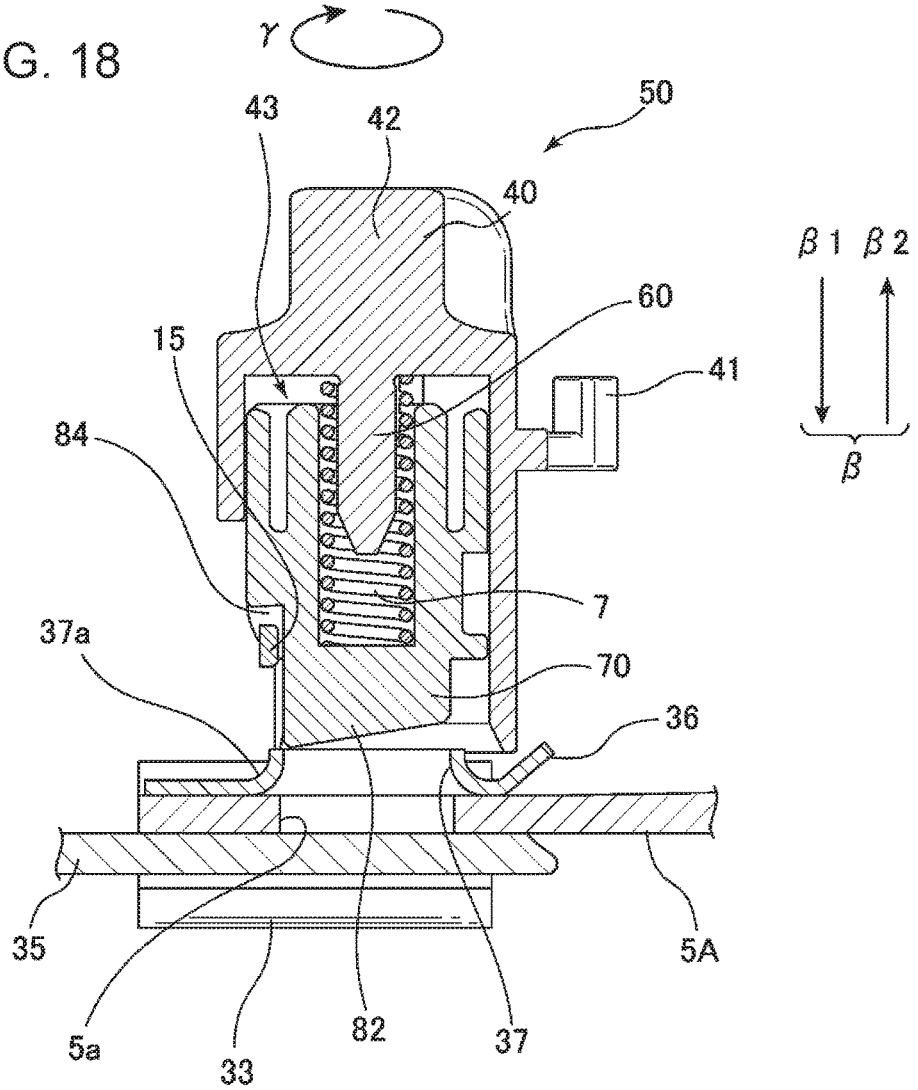
FIG. 18 is a sectional view of the unlocked state.
Figure 19:
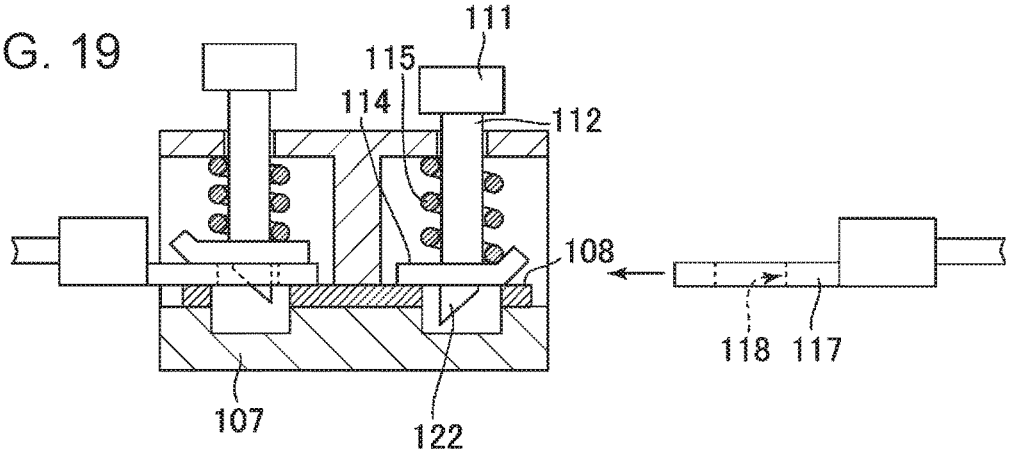
FIG. 19 shows an example of a structure of an existing terminal detachable device.

With reference to FIGS. 15 to 18, the behavior of each engaging member 70 is described. FIGS. 15 and 17 correspond to the transverse view of FIG. 5, and FIGS. 16 and 18 correspond to the sectional view of FIG. 7. FIGS. 15 to 18 are views of surrounding members, which have been extracted, of the operating unit 50 and the clamping device 30, such as the corresponding protrusion 15 that is provided on the housing 10, the terminal 5, and the corresponding upper cover 25, with their positional relationships being maintained. FIGS. 15 and 16 show a state in which the engaging member 70 is pushed down, that is, is in a locked state (the state shown in FIG. 2A), whereas FIGS. 17 and 18 show a state in which the engaging member 70 is lifted, that is, is in an unlocked state (the state shown in FIG. 2B).

When the operating member 40 is not operated at all, the action of the corresponding coil spring 7 that is provided between the operating member 40 and the engaging member 70 causes the corresponding engaging member 70 to be kept in the state shown in FIGS. 15 and 16. As is clear from FIG. 15, at this time, the protrusion 15 of the housing 10 is positioned at an upper end side of the guide groove 84 of its corresponding engaging member 70. As is clear from FIG. 16, at this time, the stopper portion 82 of the engaging member 70 is urged in the direction β1 towards the terminal 5A disposed at a predetermined position of the housing 10, and the contact portion 83 provided at an end of the stopper portion 82 is positioned in the hole 5*a* of the terminal 5A. Since, in this way, the stopper portion 82 is positioned in the hole 5*a*, the terminal 5A cannot be removed from the housing 10, more specifically, from the gap 34 of the clamping device 30, so that the engaging member 70 is engaged with the terminal 5.

In the state shown in FIGS. 15 and 16, when the operating member 40 is rotated in a direction γ with respect to the housing 10, as is clear from FIG. 17, the engaging member 70 also rotates in the direction γ in synchronism with the operating member 40. As a result, due to contact between the protrusion 15 of the housing 10 and the guide groove 84 of the engaging member 70, the engaging member 70 rotates with respect to the operating member 40 and the housing 10, and is pushed upward along the guide groove 84. As is clear from FIG. 18, the stopper portion 82 of the engaging member 70 is separated from the hole 5*a* of the terminal 5A in the direction β against the urging force of the coil spring 7, as a result of which it is possible to remove the terminal 5A from the housing 10, that is, disengage the engaging member 70 and the terminal 5 from each other.

In this way, according to the present structure, in order to engage each engaging member 70 with its corresponding terminal 5 or disengage each engaging member 70 from its corresponding terminal 5, the direction γ in which each operating member 40 is operated and the direction β in which each engaging member 70 moves from its corresponding terminal 5 can differ from each other, and each engaging member 70 is not in itself moved with respect to its corresponding terminal 5, so that the engagement of each engaging member 70 and its corresponding terminal 5 can be controlled by, for example, rotating its corresponding operating member 40. Therefore, it is possible to improve the operability of the terminal detachable device. More specifically, in the present structure, in removing the terminals, a user only needs to rotate the operating members 40. Consequently, compared to when the engaging members 70, themselves, are moved directly upward, the operability is improved. According to the embodiment, when disposing the terminals at predetermined positions of the housing 10, it is not necessary to operate the operating members 40 and is obviously not necessary to operate the engaging members 70, themselves. This is because, when mounting the terminals on the housing 10 by insertion, the terminals push the corresponding engaging members 70 in the upward direction β2 against the urging force of the corresponding coil springs 7, and are disposed at predetermined positions of the housing 10.

The present invention is not limited to the above-described embodiment, and can be variously modified.

For example, although, in the embodiment, the guide grooves 84 are used as the inclining means, the inclining means need not be guide grooves. For example, sliding surfaces may be used instead of guide grooves. Any inclining means and contacting means may be used as long as they allow the operating members 40 and the corresponding engaging members 70 to engage with each other.

Although, in the embodiment, the housing 10 includes the protrusions 15 and the engaging members 70 have the guide grooves 84, the housing 10 may have the guide grooves and the engaging members 70 may include the protrusions.

Further, instead of providing the shafts 60 at the corresponding operating members 40 and the vertical holes 80 in the corresponding engaging members 70, vertical holes may be provided in the corresponding operating members 40 and shafts may be provided at the corresponding engaging members 70.

What is claimed is:

1. A terminal detachable device comprising:

a housing;

an engaging member that moves in a first direction towards a terminal disposed at a predetermined position of the housing and that engages with the terminal, and that moves in a second direction away from the terminal disposed at the predetermined position and that disengages from the terminal; and a rotary member that is rotatably provided with respect to the housing, wherein the engaging member rotates with respect to the housing in accordance with rotation of the rotary member, and is movable in the first direction or the second direction with respect to the housing in accordance with rotation of the engaging member with respect to the housing, wherein the engaging member is urged at all times in the first direction with respect to the rotary member by elastic means, wherein the engaging member is rotatably supported by the rotary member, wherein the elastic means is provided in the first direction and the second direction around a shaft that rotatably supports the engaging member, wherein one of the rotary member and the engaging member includes the shaft extending towards the other of the rotary member and the engaging member, and wherein the other of the rotary member and the engaging member includes a hole that accommodates the shaft and the elastic means.

2. The terminal detachable device according to claim 1, further comprising:

an engagement terminal for disposing the terminal, wherein the engagement terminal has a through hole that allows a part of the engaging member to extend therethrough in the first direction and the second direction.

3. The terminal detachable device according to claim 1, wherein a part of the engaging member is accommodated in an accommodation space of the rotary member, and wherein, in the accommodation space, the engaging member is movable in the first direction or the second direction without rotating with respect to the rotary member.

4. The terminal detachable device according to claim 1, wherein the first direction and the second direction are along the shaft.

5. A terminal detachable device comprising:

a housing;

an engaging member that moves in a first direction towards a terminal disposed at a predetermined position of the housing and that engages with the terminal, and that moves in a second direction away from the terminal disposed at the predetermined position and that disengages from the terminal; and a rotary member that is rotatably provided with respect to the housing, wherein the engaging member rotates with respect to the housing in accordance with rotation of the rotary member, and is movable in the first direction or the second direction with respect to the housing in accordance with rotation of the engaging member with respect to the housing, wherein the engaging member is movable with respect to the housing in the first direction or the second direction due to contact of the engaging member with a part of the housing, wherein one of the housing and the engaging member includes inclining means that is inclined along a peripheral surface of the one of the housing and the engaging member in an acute angle direction with respect to the first direction and the second direction, and wherein the other of the housing and the engaging member includes contacting means that is capable of contacting the inclining means and that is provided in correspondence with the inclining means.

6. The terminal detachable device according to claim 5, wherein at least a part of the rotary member is accommodated in the housing, and wherein the housing has a window where at least a part of the rotary member accommodated in the housing is exposed.

7. The terminal detachable device according to claim 1, wherein the terminal is disposed at the predetermined position of the housing by being inserted into the housing in a direction orthogonal to the first direction and the second direction.

8. The terminal detachable device according to claim 1, wherein the rotary member is an operating member.

* * * * *